US009231295B2

(12) United States Patent
Chang

(10) Patent No.: US 9,231,295 B2
(45) Date of Patent: Jan. 5, 2016

(54) WEARABLE DEVICE FOR WIRELESS COMMUNICATION

(71) Applicant: Acer Incorporated, New Taipei (TW)

(72) Inventor: Chih-Hua Chang, New Taipei (TW)

(73) Assignee: ACER INCORPORATED, New Taipei (TW)

( * ) Notice: Subject to any disclaimer, the term of this patent is extended or adjusted under 35 U.S.C. 154(b) by 252 days.

(21) Appl. No.: 13/970,822

(22) Filed: Aug. 20, 2013

(65) Prior Publication Data

US 2014/0320357 A1 Oct. 30, 2014

(30) Foreign Application Priority Data

Apr. 29, 2013 (TW) ..... 102115202 A

(51) Int. Cl.
*H01Q 1/27* (2006.01)
*H01Q 5/378* (2015.01)
*H01Q 1/24* (2006.01)

(52) U.S. Cl.
CPC ..... *H01Q 1/273* (2013.01); *H01Q 1/243* (2013.01); *H01Q 5/378* (2015.01)

(58) Field of Classification Search
CPC ..... H01Q 1/273; H01Q 1/243; H01Q 5/378
USPC ..... 343/702
See application file for complete search history.

(56) References Cited

U.S. PATENT DOCUMENTS 5,465,098 A * 11/1995 Fujisawa ..... H01Q 13/10 343/718
5,564,082 A * 10/1996 Blonder ..... G04G 21/04 343/718
5,886,669 A * 3/1999 Kita ..... H01Q 1/273 343/700 MS
5,926,144 A * 7/1999 Bolanos ..... G04B 47/025 343/718
6,611,504 B1 * 8/2003 Kanda ..... H01Q 1/243 343/702
7,038,634 B2 * 5/2006 Bisig ..... H01Q 7/00 343/718
7,828,697 B1 * 11/2010 Oberrieder ..... A63B 24/0062 482/1
2003/0169207 A1 * 9/2003 Beigel ..... G06K 19/07762 343/718
2007/0146218 A1 * 6/2007 Turner ..... H01Q 1/273 343/718
2012/0235866 A1 * 9/2012 Kim et al. ..... 343/700 MS
2013/0016016 A1 * 1/2013 Lin ..... H01Q 1/273 343/702
2014/0368391 A1 * 12/2014 Onaka ..... H01Q 7/00 343/718
2015/0070226 A1 * 3/2015 Wong ..... H01Q 1/273 343/718

OTHER PUBLICATIONS

TW Office Action dated Jun. 16, 2015 in corresponding Taiwan application (No. 102115202).

(Continued)

*Primary Examiner* — Dameon E Levi
*Assistant Examiner* — Jennifer F Hu
(74) *Attorney, Agent, or Firm* — McClure, Qualey & Rodack, LLP

(57) ABSTRACT

A wearable device for wireless communication includes a device body, a wearable belt, a ground element, a feeding element, and a radiation element. The device body substantially has a central hollow structure. The ground element and the feeding element are both disposed in the device body. The feeding element is coupled to a signal source. The radiation element is disposed on a surface of the wearable belt or in the wearable belt, and is disposed adjacent to the feeding element. A coupled-fed antenna structure is formed by the feeding element and the radiation element.

10 Claims, 4 Drawing Sheets

(56) References Cited

OTHER PUBLICATIONS

Chu, et al.: "Internal Coupled-Fed Dual-L.oop Antenna Integrated With a USB Connector for WWANILTE Mobile Handset"; IEEE Transactions on Antennas and Propagation, vol. 59, No. 11, Nov. 2011; pp. 4215-4221.

* cited by examiner

WEARABLE DEVICE FOR WIRELESS COMMUNICATION

CROSS REFERENCE TO RELATED APPLICATIONS

This Application claims priority of Taiwan Patent Application No. 102115202 filed on Apr. 29, 2013, the entirety of which is incorporated by reference herein.

BACKGROUND OF THE INVENTION

1. Field of the Invention

The disclosure generally relates to a wearable device, and more particularly, relates to a wearable device for wireless communication.

2. Description of the Related Art

With the progress of mobile communication technology, portable electronic devices, for example, portable computers, mobile phones, tablet computer, multimedia players, and other hybrid functional mobile devices, have become more common To satisfy the demand of users, portable electronic devices usually can perform wireless communication functions. Some functions cover a large wireless communication area, for example, mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some functions cover a small wireless communication area, for example, mobile phones using Wi-Fi, Bluetooth, and WiMAX (Worldwide Interoperability for Microwave Access) systems and using frequency bands of 2.4 GHz, 3.5 GHz, 5.2 GHz, and 5.8 GHz.

According to research, some predict the next generation of mobile devices will be "wearable devices". For example, wireless communication may be applied to watches, glasses, and even clothes in the future. However, watches, for example, do not have a large space to accommodate antennas for wireless communication. Accordingly, this is a critical challenge for antenna designers.

BRIEF SUMMARY OF THE INVENTION

In one exemplary embodiment, the disclosure is directed to a wearable device for wireless communication, comprising: a device body, substantially having a central hollow structure; a wearable belt; a ground element, disposed in the device body; a feeding element, disposed in the device body, and coupled to a signal source; and a first radiation element, disposed on a surface of the wearable belt or in the wearable belt, and disposed adjacent to the feeding element, wherein a coupled-fed antenna structure is formed by the feeding element and the first radiation element.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures thereof in the invention are shown in detail as follows.

Figure 1A:
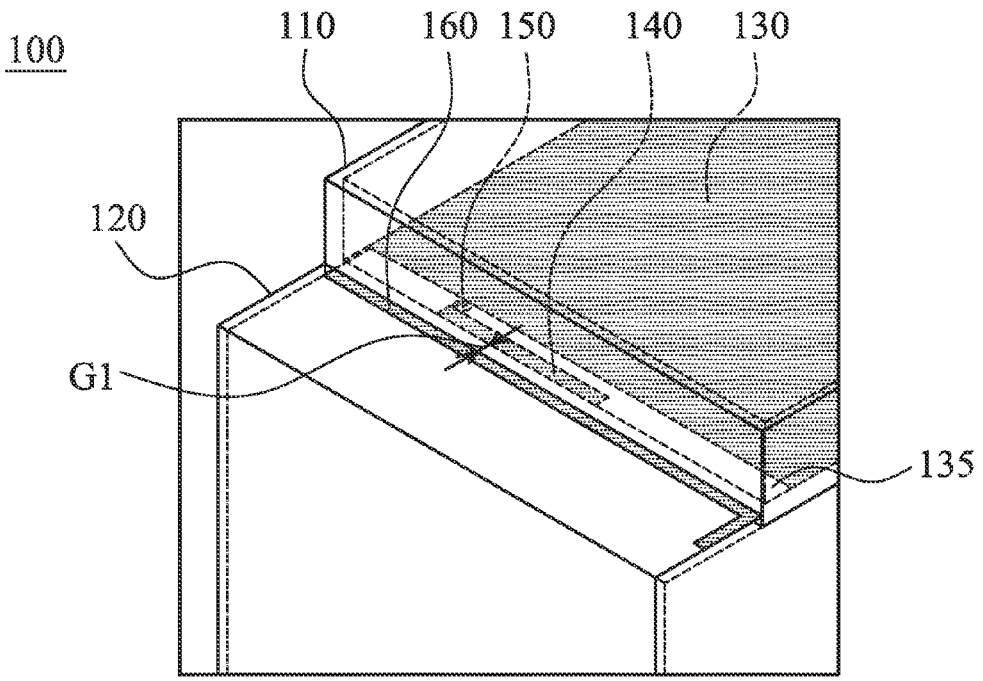
FIG. 1A is a perspective view for illustrating a wearable device according to an embodiment of the invention.
Figure 1B:
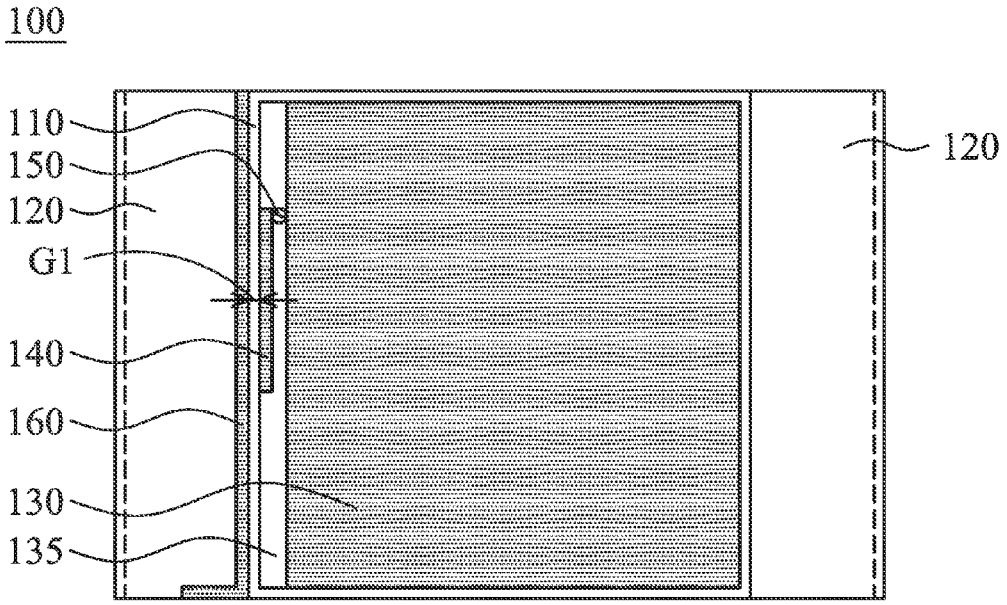
FIG. 1B is a top view for illustrating a wearable device according to an embodiment of the invention.

FIG. 1A is a perspective view for illustrating a wearable device 100 according to an embodiment of the invention. FIG. 1B is a top view for illustrating the wearable device 100 according to an embodiment of the invention. The wearable device 100 may be a smart wearable device for wireless communication, and the smart wearable device may establish a wireless connection to a mobile device, such as a Wi-Fi connection or a Bluetooth connection. Please refer to FIG. 1A and FIG. 1B together. As shown in FIG. 1A and FIG. 1B, the wearable device 100 comprises a device body 110, a wearable belt 120, a ground element 130, a feeding element 140, a signal source 150, and a first radiation element 160. In some embodiments, the device body 110 and the wearable belt 120 are made of nonconductive materials, such as plastic materials or acrylic materials. In some embodiments, the ground element 130, the feeding element 140, and the first radiation element 160 are made of metal, such as copper, silver, aluminum, or iron. The device body 110 substantially has a central hollow structure. The wearable belt 120 is attached to the device body 110. The styles, shapes, sizes, and colors of the device body 110 and the wearable belt 120 are not limited in the invention. In a preferred embodiment, the wearable device 100 is a watch, the device body 110 is a watch body, and the wearable belt 120 is a watch belt. Note that the wearable device 100 may further comprise other components, such as a transparent watch glass, an electronic display, an hour hand, a minute hand, a second hand, a calendar, a thermometer, a hygrometer, and/or a barometer (not shown).

The ground element 130 may be a system ground plane of the wearable device 100. The ground element 130 and the feeding element 140 are both disposed in the device body 110. More particularly, the ground element 130 is disposed on an inner bottom surface of the device body 110. The inner bottom surface further has a non-grounding region 135, and the feeding element 140 is disposed on the inside of the non-grounding region 135. The feeding element 140 is coupled to the signal source 150. The first radiation element 160 is disposed on a surface of the wearable belt 120 or in the wearable belt 120, and is disposed adjacent to the feeding element 140. A coupled-fed antenna structure is formed by the feeding element 140 and the first radiation element 160. In some embodiments, a length of a first coupling gap G1 between the feeding element 140 and the first radiation element 160 is smaller than 2 mm. In some embodiments, the feeding element 140 substantially has a straight-line shape, and the first radiation element 160 substantially has an L-shape. Note that the invention is not limited to the above. In other embodiments, any of the feeding element 140 and the first radiation element 160 may have other shapes, such as a straight-line shape, an L-shape, a J-shape, a U-shape, an S-shape, or a W-shape.

In the invention, the feeding element 140 of the coupled-fed antenna structure is disposed in the device body 110, and the first radiation element 160 of the coupled-fed antenna structure is disposed on or in the wearable belt 120. Since the feeding element 140 and the first radiation element 160 are separate and transmit energy to each other by mutual coupling, the invention can reduce the risk of instability of the antenna connection when the wearable device 100 is fabricated. In addition, the first radiation element 160 is not disposed in the device body 110, and accordingly, the design of the coupled-fed antenna structure is not limited by the narrow inner space of the device body 110. The invention has the advantages of both improving product yields and maintaining good communication quality.

Figure 2:
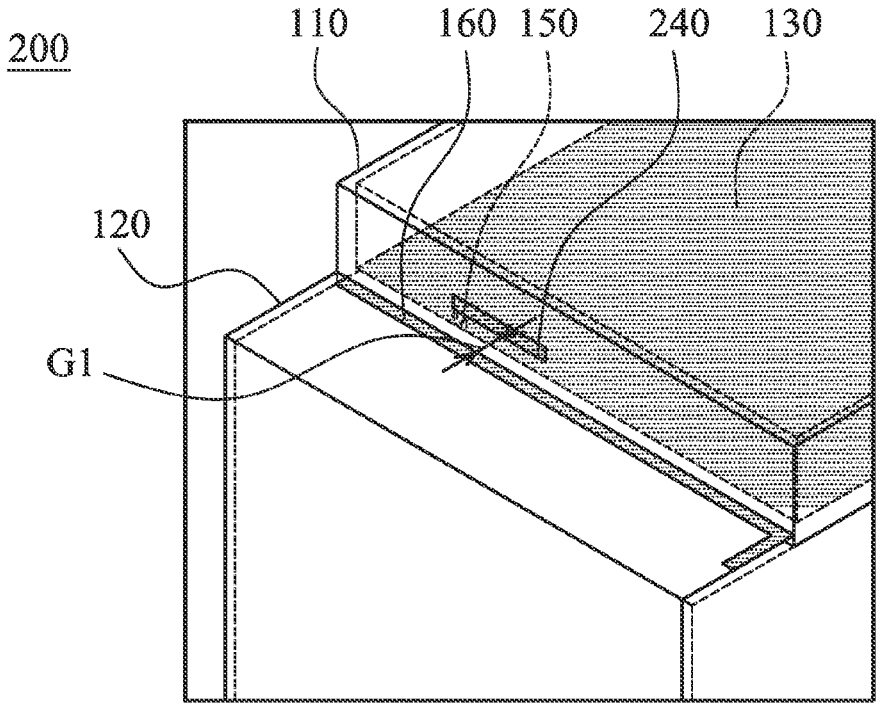
FIG. 2 is a perspective view for illustrating a wearable device according to an embodiment of the invention.

FIG. 2 is a perspective view for illustrating a wearable device 200 according to an embodiment of the invention. FIG. 2 is similar to FIG. 1A and FIG. 1B. The difference from the embodiment of FIG. 1A and FIG. 1B is that a feeding element 240 of the wearable device 200 is disposed on an inner side surface of the device body 110. In addition, a ground element 230 of the wearable device 200 is disposed on an inner bottom surface of the device body 110. The inner side surface is adjacent and perpendicular to the inner bottom surface. In the embodiment of FIG. 2, since the feeding element 240 is not disposed on the inner bottom surface of the device body 110, all of the inner bottom surface is used to accommodate the ground element 230 and other wearable device components (not shown), thereby increasing the freedom of design. Other features of the wearable device 200 of FIG. 2 are similar to those of the wearable device 100 of FIG. 1A and FIG. 1B. Accordingly, the two embodiments can achieve similar performances.

Figure 3:
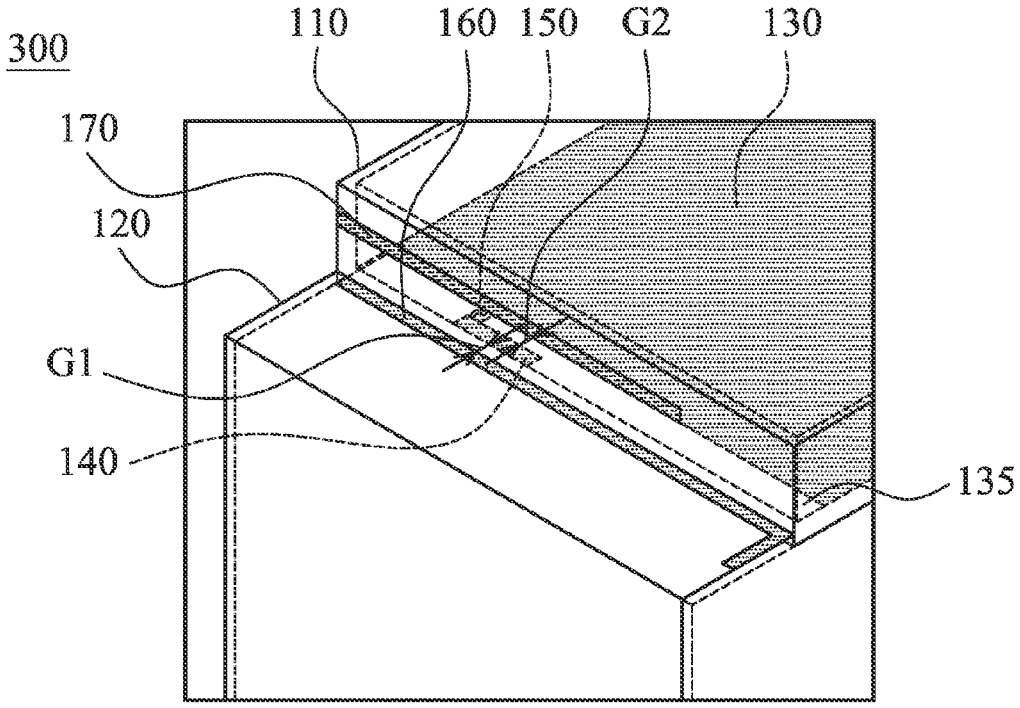
FIG. 3 is a perspective view for illustrating a wearable device according to an embodiment of the invention.

FIG. 3 is a perspective view for illustrating a wearable device 300 according to an embodiment of the invention. FIG. 3 is similar to FIG. 1A and FIG. 1B. The difference from the embodiment of FIG. 1A and FIG. 1B is that the wearable device 300 further comprises a second radiation element 170. In some embodiments, the second radiation element 170 is made of metal, such as copper, silver, aluminum, or iron. The second radiation element 170 is disposed separately from the feeding element 140 and the first radiation element 160, and is disposed adjacent to the feeding element 140. A coupled-fed antenna structure of the wearable device 300 is formed by the feeding element 140, the first radiation element 160, and the second radiation element 170. In some embodiments, a length of a first coupling gap G1 between the feeding element 140 and the first radiation element 160 is smaller than 2 mm, and a length of a second coupling gap G2 between the feeding element 140 and the second radiation element 170 is also smaller than 2 mm. In some embodiments, the second radiation element 170 is disposed on an outer side surface of the device body 110, and substantially has a straight-line shape. Note that the invention is not limited to the above. In other embodiments, the second radiation element 170 may substantially have other shapes, such as an L-shape, a J-shape, a U-shape, an S-shape, or a W-shape. In the embodiment of FIG. 3, since the coupled-fed antenna structure comprises the first radiation element 160 and the second radiation element 170, the coupled-fed antenna structure can cover multiple bands, such as a GPS (Global Positioning System) band and a WLAN (Wireless Local Area Network) band. Other features of the wearable device 300 of FIG. 3 are similar to those of the wearable device 100 of FIG. 1A and FIG. 1B. Accordingly, the two embodiments can achieve similar performances.

Figure 4:
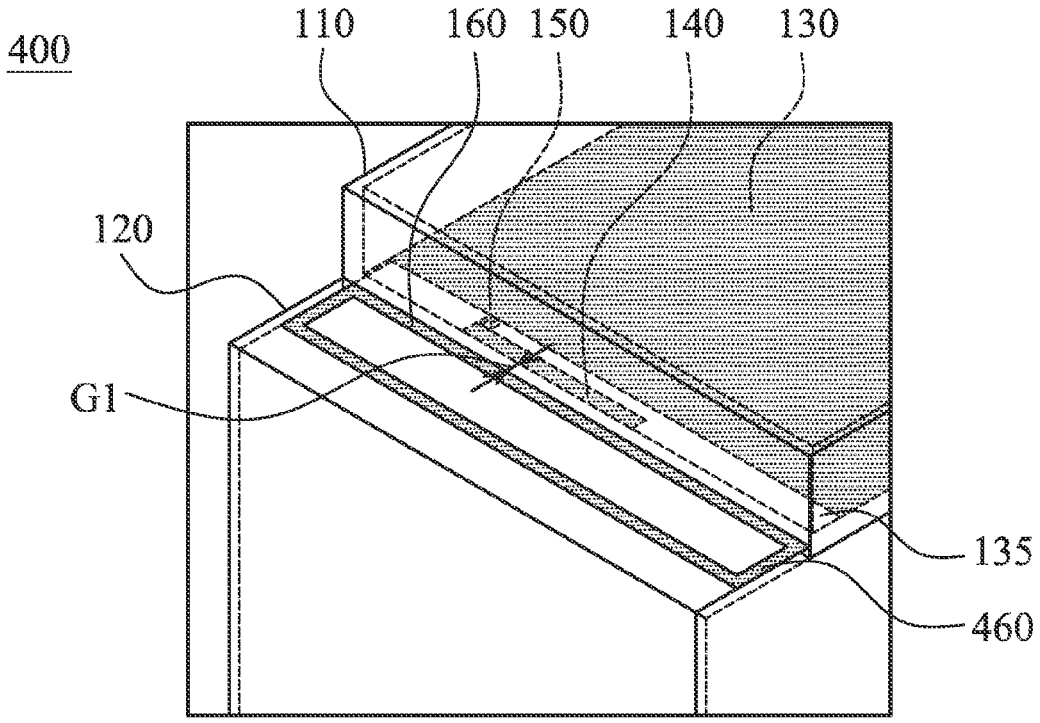
FIG. 4 is a perspective view for illustrating a wearable device according to an embodiment of the invention.

FIG. 4 is a perspective view for illustrating a wearable device 400 according to an embodiment of the invention. FIG. 4 is similar to FIG. 1A and FIG. 1B. The difference from the embodiment of FIG. 1A and FIG. 1B is that a first radiation element 460 of the wearable device 400 substantially forms a closed loop. In some embodiments, the closed loop substantially has a hollow rectangular shape (as shown in FIG. 4), a hollow circular shape, or a hollow elliptical shape. Other features of the wearable device 400 of FIG. 4 are similar to those of the wearable device 100 of FIG. 1A and FIG. 1B. Accordingly, the two embodiments can achieve similar performances.

Figure 5:
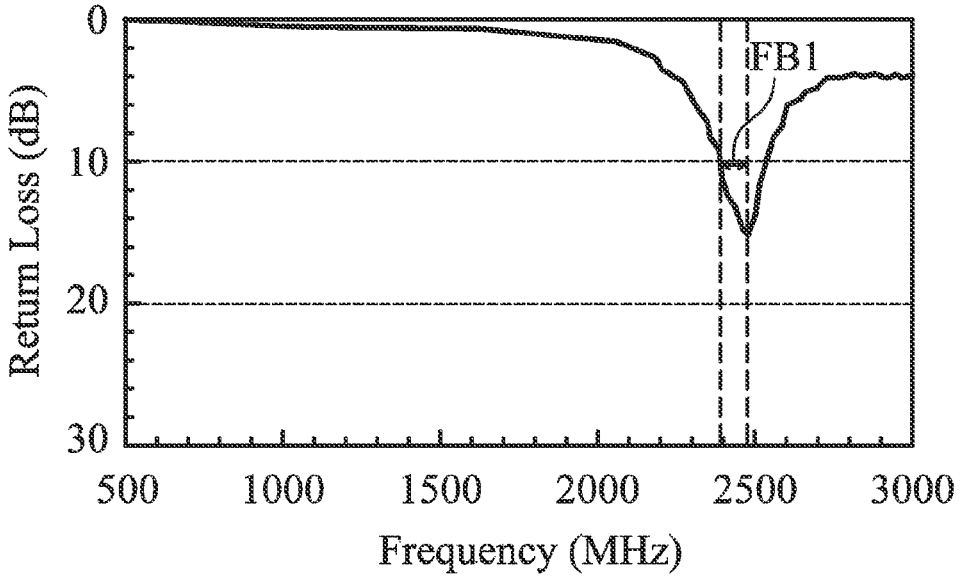
FIG. 5 is a diagram for illustrating return loss of a coupled-fed antenna structure of a wearable device according to an embodiment of the invention.

FIG. 5 is a diagram for illustrating return loss of the coupled-fed antenna structure of the wearable device 100 according to an embodiment of the invention. The horizontal axis represents operation frequency (MHz), and the vertical axis represents the return loss (dB). As shown in FIG. 5, the coupled-fed antenna structure is configured to cover an operation band FBI. In a preferred embodiment, the operation band FB1 is substantially from 2400 MHz to 2484 MHz. Accordingly, the wearable device 100 of the invention can operate in at least a WLAN 2.4 GHz band and support a Wi-Fi wireless connection.

Figure 6:
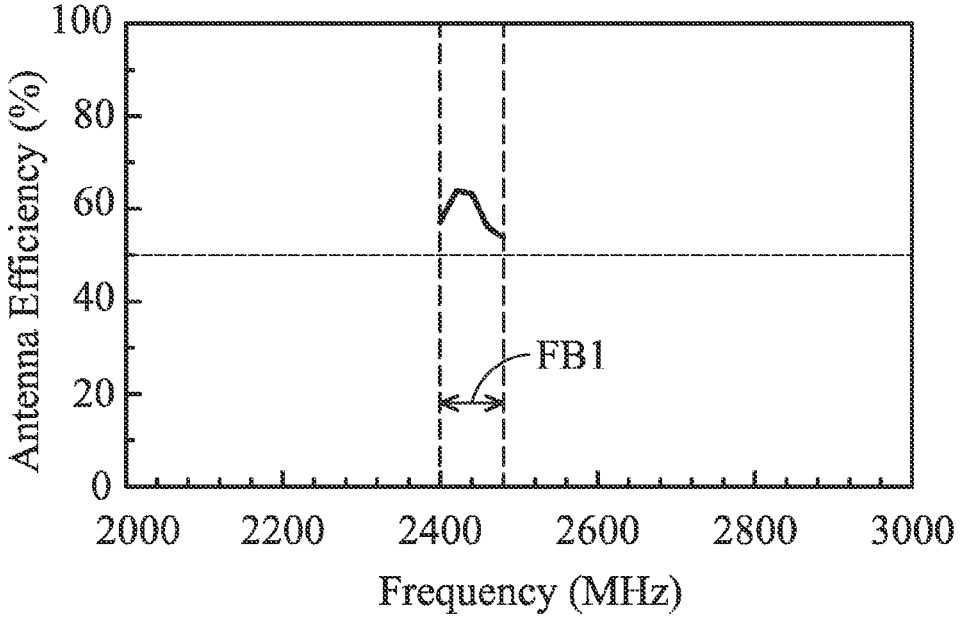
FIG. 6 is a diagram for illustrating antenna efficiency of a coupled-fed antenna structure of a wearable device according to an embodiment of the invention.

FIG. 6 is a diagram for illustrating antenna efficiency of the coupled-fed antenna structure of the wearable device 100 according to an embodiment of the invention. The horizontal axis represents operation frequency (MHz), and the vertical axis represents the antenna efficiency (%). As shown in FIG. 6, the antenna efficiency of the coupled-fed antenna structure is substantially greater than 50% in the operation band FB1 and meets practical application requirements.

In some embodiments, the sizes and parameters of the elements of the invention are as follows. Please refer to FIG. 1A and FIG. 1B again. The device body 110 has a length of about 40 mm, a width of about 40 mm, and a height of about 4 mm. Each side wall of the device body 110 has a thickness of about 0.8 mm. The ground element 130 has a length of about 38.4 mm and a width of about 36.4 mm. The non-grounding region 135 has a length of about 38.4 mm and a width of about 2 mm. The feeding element 140 has a length of about 16 mm and a width of about 1 mm. The first radiation element 160 has a length of about 45 mm and a width of about 1 mm. The first coupling gap G1 has a length of about 0.8 mm.

Note that the above element sizes, element parameters, element shapes, and frequency ranges are not limitations of the invention. An antenna designer may adjust these settings according to different requirements.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

It will be apparent to those skilled in the art that various modifications and variations can be made in the invention. It is intended that the standard and examples be considered as exemplary only, with a true scope of the disclosed embodiments being indicated by the following claims and their equivalents.

What is claimed is:

1. A wearable device for wireless communication, comprising:

a device body, substantially having a central hollow structure;

a wearable belt;

a ground element, disposed in the device body;

a feeding element, disposed in the device body, and coupled to a signal source; and a first radiation element, disposed on a surface of the wearable belt or in the wearable belt, and disposed adjacent to the feeding element, wherein a coupled-fed antenna structure is formed by the feeding element and the first radiation element;

wherein the first radiation element is completely separate from the ground element and the feeding element;

wherein the wearable device further comprises:

a second radiation element, separated from the first radiation element, and disposed adjacent to the feeding element, wherein the coupled-fed antenna structure further comprises the second radiation element, and the second radiation element is disposed on an outer side surface of the device body;

wherein the second radiation element is substantially parallel to the first radiation element.

2. The wearable device as claimed in claim 1, wherein the device body and the wearable belt are made of nonconductive materials.

3. The wearable device as claimed in claim 1, wherein the ground element is disposed on an inner bottom surface of the device body, and the inner bottom surface further has a non-grounding region, and the feeding element is disposed on the inside of the non-grounding region.

4. The wearable device as claimed in claim 1, wherein the feeding element substantially has a straight-line shape.

5. The wearable device as claimed in claim 1, wherein the first radiation element substantially has an L-shape or substantially forms a closed loop.

6. The wearable device as claimed in claim 1, wherein a length of a first coupling gap between the feeding element and the first radiation element is smaller than 2 mm.

7. The wearable device as claimed in claim 1, wherein the coupled-fed antenna structure is configured to cover an operation band which is substantially from 2400 MHz to 2484 MHz.

8. The wearable device as claimed in claim 1, wherein the ground element is disposed on an inner bottom surface of the device body, and the feeding element is disposed on an inner side surface of the device body, and the inner side surface is adjacent and perpendicular to the inner bottom surface.

9. The wearable device as claimed in claim 1, wherein a length of a second coupling gap between the feeding element and the second radiation element is smaller than 2 mm.

10. The wearable device as claimed in claim 1, wherein the second radiation element substantially has a straight-line shape.

* * * * *